US006059291A

United States Patent [19]

Gary

[11] Patent Number: 6,059,291

[45] Date of Patent: May 9, 2000

[54] METHOD OF PLAYING A LEARNING ENHANCED CARD GAME

[76] Inventor: Harold L Gary, 2302 Eagles Way, Pearland, Tex. 77581

[21] Appl. No.: 09/097,038

[22] Filed: Jun. 12, 1998

[51] Int. Cl.[7] ..... A63F 1/00; A63F 9/18

[52] U.S. Cl. ..... 273/300; 273/302; 273/303; 273/306; 273/431; D21/376

[58] Field of Search ..... 273/292, 299, 273/300, 302, 303, 304, 306, 308, 429–432; D21/376

[56] References Cited

U.S. PATENT DOCUMENTS

| | | | |
|---|---|---|---|
| 305,018 | 9/1884 | Ramsey | 273/300 |
| 807,433 | 12/1905 | Blanchard | 273/300 |
| 1,323,713 | 12/1919 | Meriwether | 273/300 |
| 1,417,434 | 5/1922 | Weiss | 273/302 |
| 1,638,433 | 8/1927 | Copeland | 273/302 |
| 4,090,717 | 5/1978 | Rossetti | 273/302 |
| 5,863,043 | 1/1999 | Bitner | 273/299 |

OTHER PUBLICATIONS

"Memory", The Way to Play, The Diagram Group, Paddington Press, Ltd., p. 306, 1975.

*Primary Examiner*—Benjamin H. Layno
*Attorney, Agent, or Firm*—Patent Pro

[57] ABSTRACT

A learning enhancing card game comprises four or more suits of cards, each card having a front side and back side, each suit comprising a predetermined number of first cards having information thereon and a corresponding predetermined number of second cards, each second card having information correlated to information on one of the first cards from the suit, and two or more wild cards, each having a front side and a back side. The card information relates to religious studies, in particular the Christian Bible and each suit is topically related to each other such as peace, love, faith, commandments, evil, happiness, prayer, and hope. A shuffled deck of cards with a face side having at least four suits, each suit having a predetermined number of first cards with information on the face side and the same predetermined number of second cards, each second card is correlated to one of the first cards, and two or more wild card, from the shuffled deck, a predetermined number of cards comprising a hand are dealt each to a predetermined number of players, the remaining cards are placed face side down in a stack; each player takes successive turns by turning over the top card in the stack and attempting to match the card with the corresponding card in the players' hand. If a match is made, the same player turns the next card in the stack over and tries to match that card and continues until unable to match the turned card; and if a match is not made, play goes to the next player or, in the event the player has a wild card, the wild card is exchanged for another turn. A scoring method is based on the number of matches made.

3 Claims, 3 Drawing Sheets

METHOD OF PLAYING A LEARNING ENHANCED CARD GAME

BACKGROUND OF THE INVENTION

This invention relates generally to the field of card games, and more particularly to a learning enhancing card game.

There exist many card games, both for a player to play individually and against others, as well as in groups and/or pairs. There also exist many games for enhancing learning, including board games and even board games incorporating cards. Each prior card/board game has deficiencies that the present invention overcomes.

SUMMARY OF THE INVENTION

An object of the invention is to provide a method for learning, memorizing, and at the same time provide an atmosphere of fun and entertainment.

A further object of the invention is to provide motivation for learning.

Yet another object of the invention is to provide a challenge of ability among friends and family.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, a learning enhancing card game comprises four or more suits of cards, each card having a front side and back side, each suit comprising a predetermined number of first cards having information thereon and a corresponding predetermined number of second cards, each second card having information correlated to information on one of the first cards from the suit, and two or more wild cards, each having a front side and a back side. In the illustrated embodiment, the game has information relating to religious studies, and in particular the Christian Bible where each suit is topically related to each other such as the topics of peace, love, faith, commandments, evil, happiness, prayer, and hope.

In another preferred embodiment of the invention, a card game has the following rules: a shuffled deck of cards with a face side having at least four suits, each suit having a predetermined number of first cards with information on the face side and the same predetermined number of second cards, each second card is correlated to one of the first cards, and two or more wild card, from the shuffled deck, a predetermined number of cards comprising a hand are dealt each to a predetermined number of players, the remaining cards are placed face side down in a stack; each player takes successive turns by turning over the top card in the stack and attempting to match the card with the corresponding card in the players' hand.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
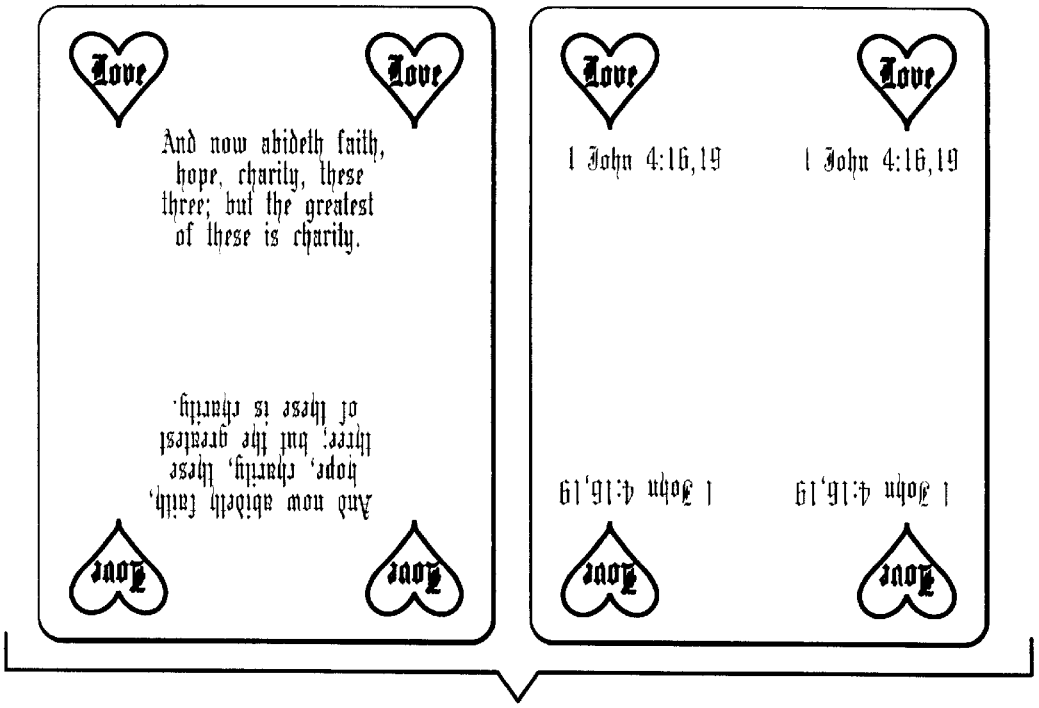
FIG. 1 is a perspective view of the invention showing the first of four (4) suits that describes "Love" with its matching VERSE and SCRIPTURE cards and icon.
Figure 2:
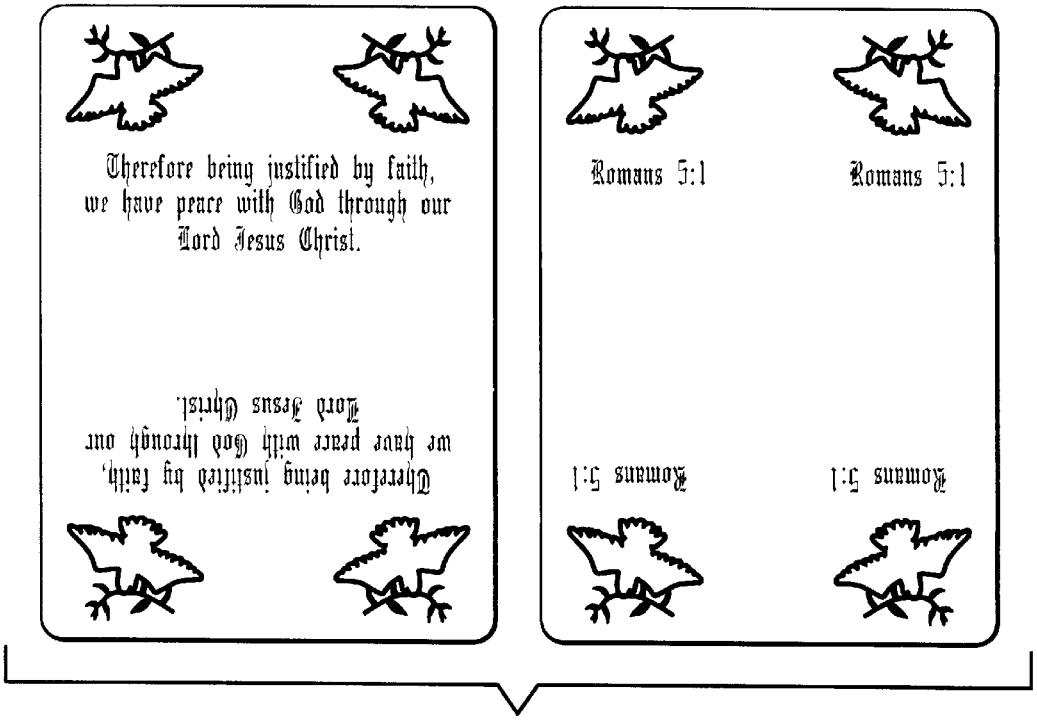
FIG. 2 is a perspective view of the invention showing the second of four (4) suits that describes "Peace" with its matching VERSE and SCRIPTURE cards and icon.
Figure 3:
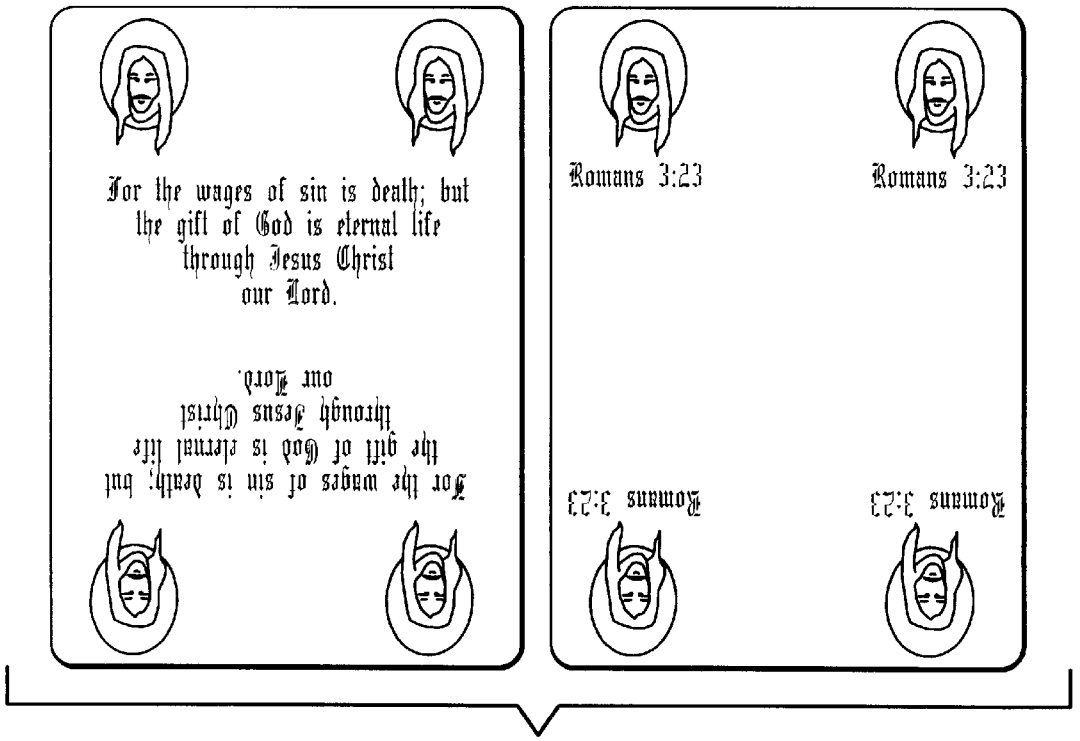
FIG. 3 is a perspective view of the invention showing the third of four (4) suits that describes "Salvation" with its matching VERSE and SCRIPTURE cards and icon.
Figure 4:
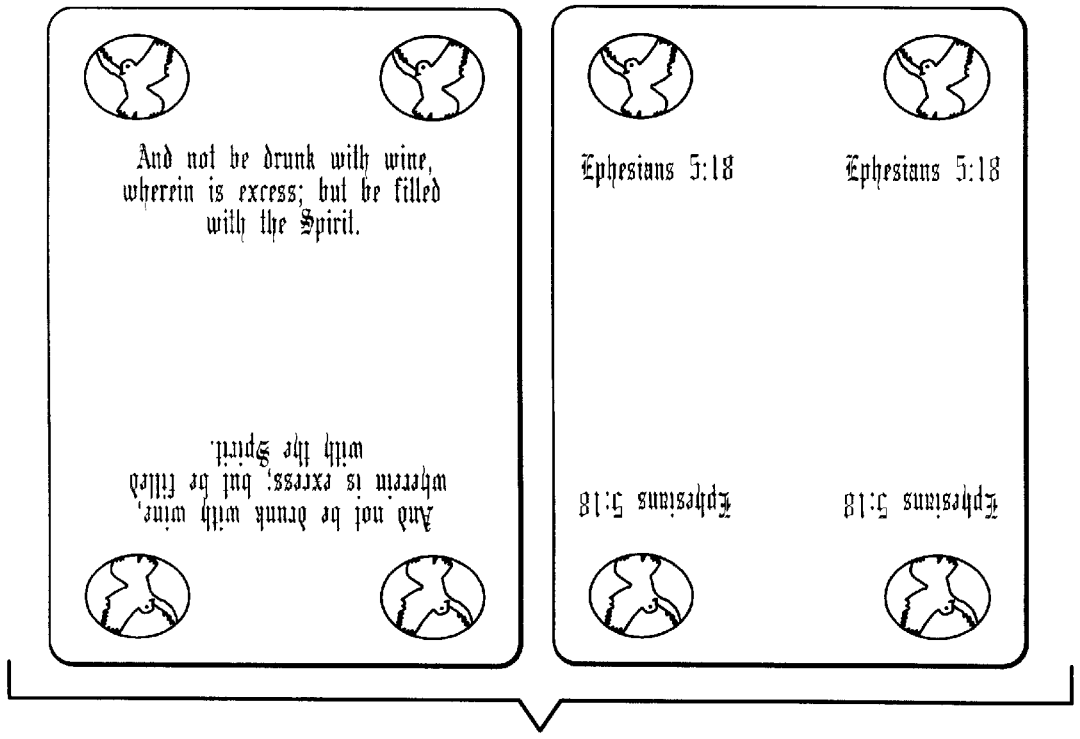
FIG. 4 is a perspective view of the invention showing the fourth of four (4) suits that describes "Holy Spirit" with its matching VERSE and SCRIPTURE cards and icon.
Figure 5:
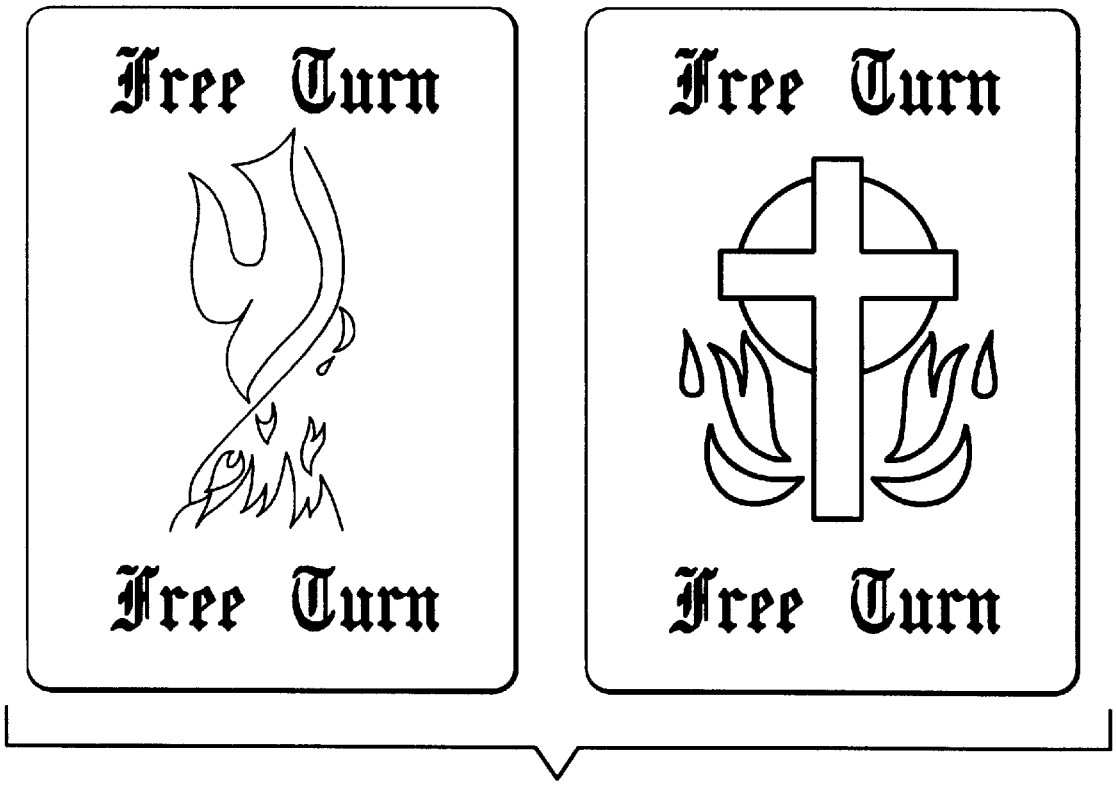
FIG. 5 is a perspective view of the invention showing additional cards used for book marks and including the two CROSS and DOVE free turn cards.

This learning enhancing card game consists of four or more suits of cards, each card having a front side and back side; each suit comprising a predetermined number of first cards having information thereon and a corresponding predetermined number of second cards, each second card having information correlated to information on one of the first cards from the suit as shown in FIGS. 1 through 4, and two or more wild cards, each having a front side and a back side as shown in FIG. 5. This is a trick-based card game that can be played as solitaire for the individual player, or with two players, one player competing with another, or two or more teams consisting of two members each.

For each hand, the single or team players bid, see How to Bid and Keeping Score, below, to take a number of matches or tricks, and the scoring penalizes teams which take more tricks than they bid, see Over bidding. The card deck is made up of four (4) different suits as shown in FIGS. 1 through 4, but could be more than four different suits; each suit containing different subjects or topics ranging from any type of subject matter or topics, e.g., any religious subject matter regardless of religion, denomination, church affiliation, sect, or spiritual beliefs; any subject matter or topics that would include information relating to and concerning the sciences, physics, mathematics, history, government, chemistry, archeology, all world languages and including subject matter or topics concerning the world, federal, national, state, and local city government; or any topic of discussion.

Each suit has its own subject matter or topic and contains a first and second card set with matching information that topically relates the two as a complete set. There is a match or marriage to every card making a trick or a union.

In the illustrated embodiment using the Christian bible, each of the four suits is made up of not only different topic or subject matter, but contains six VERSE cards, each having a predetermined Chapter and Verse location as shown in FIGS. 1 through 4 and six SCRIPTURE cards, each having a printed and spell out scripture that matches and marries with the proper VERSE card as shown in FIGS. 1 through 4.

The match or trick is where the points of the game are earned when a union or marriage is made complete; matching the first card with its topic or subject matter and correlating it to the second card with its topic or subject matter. The tricks or matches are counted as points which are applied toward the current player's total scored points, e.g., first player to obtain total scored points through matching the first or second card correctly, and earning (500) five hundred total points, wins the game. The total scored points ending the game can be predetermined by players before play begins, e.g., from (100) one hundred to (1,000) one thousand total scored points; whatever the players choose as a group.

HOW TO BID: Each single player or team must have a bid before the game begins. The bid is the number of matches or tricks the single player or team believes, based on their own knowledge, they can try to win in the course of the game. In the illustrated embodiment, the number of matches or tricks a single player or team can bid must between (4) four and (24) twenty-four.

KEEPING SCORE: Scoring is based on the number of matches or tricks taken or won by single or team players. In the illustrated embodiment, for a bid of (4) four through (12) twelve matches or tricks, if the number of matches or tricks taken is lower than the bid, single or team players must subtract (10) points from each match or trick under bid. If the number of matches or tricks taken is at least the bid quoted before the game began, single or team players receive (10) ten points for each match or trick won plus (1) one point for each extra match or trick taken above the bid as quoted before the game began. For a bid of (13) thirteen through (24) twenty-four matches or tricks, if the number of matches or tricks taken is lower than the bid, single or team players must subtract (10) points for each match or trick under bid. If the number of matches or tricks taken is at least the bid quoted before the game began, single or team players receive (20) twenty points for each match or trick won plus (1) point for each extra match or trick taken above the bid as quoted before the game began.

OVER BIDDING: When the single or team players accumulates (10) ten or more extra matches or tricks, over and above what they bid before the game began, during a game, the single or team players receive a penalty of (50) fifty points for overbidding. An additional (50) fifty points is also levied against the single or team players if (20) twenty extra matches or tricks exceed their pre-game bid quote.

A deck of (48) forty-eight cards are used as shown in FIGS. 1 through 4, but could be more or less, and includes additional (2) two wild cards as shown in FIG. 5, more or less could also be used, redeemable for free turns during the course of the game. For example, the current player has in their hand a wild card, whether dealt or drawn from the deck of cards. The players have the option to redeem the card for a free turn if they mismatch the first and second card incorrectly. If the wild card is redeemed for a free turn, the current player is given another chance to try and make a correct match of the first and second card; once the wild card is redeemed, it is returned to the bottom of or could be shuffled into the unused card deck.

To begin the game, the cards are shuffled and a dealer is chosen to deal (4) four cards, could be more or less, to each player. The remaining cards are placed face down in the middle of a table or playing field. The player to the left, could also be the player to the right if desired, of the dealer begins first and turns the top card from the deck over, laying it next to the deck face up. If the current player can match one of their dealt cards from the first or second card set with the card face up, then the match or trick becomes theirs and they must draw a new card for their hand from the top of the deck, thus, keeping a total of (4) cards in their hand if (4) four cards are dealt from the beginning of play, and turn a new card from the same deck face up to be played against. If the current player can match the new card, now face up, with existing held cards, the match must be laid down and counted as a trick. A new card must be drawn from the top of the deck keeping a total of (4) cards in the players hand at all times and again, a new card must be turned over from the deck face up to be played against. This process continues until the current player cannot match the card turned face up or match any cards in his or her hand. If the next player so chooses, from the beginning of their play, they have the option to pick-up the new card that has been turned over face up by the previous player and discard one of their existing held cards (maybe a card they do not know the match to) from their current hand in its place, now making the player's discarded card the current face up card on the table or playing field. Taking this option will help keep all the players dealt hands from growing stale. The current player then makes their choice on how to play their hand.

Each player takes successive turns by making the decision to discard one of their previously held cards and picking up the new card turned over or discarded by the previous player, placing it in their hand always keeping a total of (4) four held cards or choosing to turn a new card over from the deck in case they cannot make a match and attempting to match this card with the corresponding card held in their hand. If a match is made, the same player draws a new card from the top of the deck for their hand always keeping a total of (4) four held cards and turns the next card in the deck over face up on the table or playing field and the process starts all over again. If a match cannot be made, the current player states that they "pass" and the play goes to the next player or, in the even the player has a wild card, as shown in FIG. 5, the wild card is exchanged for a free turn.

This process continues until most cards are matched. Once the deck has been drawn down, the unmatched cards are reshuffled and the process continues. Once the deck has been depleted, the game is over and points are totaled. Players possibly will still be holding unmatched cards in their hand which are only to be reshuffled in the next new game.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A method of playing a card game comprising the steps of:

a shuffled deck of cards with a face side having at least four suits, each suit having a predetermined number of first cards with information on the face side and the same predetermined number of second cards, each second card is correlated to one and only one of the first cards, and two or more wild cards;

from the shuffled deck, a predetermined number of cards comprising a hand are dealt each to a predetermined number of players, the remaining cards are placed face side down in a stack;

each player takes successive turns by turning over the top card in the stack and attempting to match the card with the corresponding card in the players' hand.

2. A method of playing a card game as claimed in claim 1 further comprising the steps of:

if a match is made, the same player turns the next card in the stack over and tries to match that card and continues until unable to match the turned card; and if a match is not made, play goes to the next player or, in the event the player has a wild card, the wild card is exchanged for another turn.

3. A method of playing a card game as claimed in claim 1 further comprising the step of:

a scoring method based on the number of matches made.

* * * * *